US006620029B2

(12) United States Patent
Khoury et al.

(10) Patent No.: US 6,620,029 B2
(45) Date of Patent: Sep. 16, 2003

(54) APPARATUS AND METHOD FOR FRONT SIDE CHEMICAL MECHANICAL PLANARIZATION (CMP) OF SEMICONDUCTOR WORKPIECES

(75) Inventors: Raymond M. Khoury, Wappingers Falls, NY (US); Jose M. Ocasio, Maybrook, NY (US); Uldis A. Ziemins, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 15 days.

(21) Appl. No.: 10/059,775

(22) Filed: Jan. 30, 2002

(65) Prior Publication Data

US 2003/0143930 A1 Jul. 31, 2003

(51) Int. Cl.[7] ..... B24B 1/00

(52) U.S. Cl. ..... 451/6; 451/41; 451/67; 451/242; 451/285; 451/398; 451/443

(58) Field of Search ..... 451/41, 190, 194, 451/44, 182, 184, 188, 443, 72, 56, 6, 242, 285–289, 461, 67, 398; 125/11.03, 11.01

(56) References Cited

U.S. PATENT DOCUMENTS 5,665,656 A 9/1997 Jairath
5,700,179 A 12/1997 Hasegawa et al.
5,707,274 A 1/1998 Kim et al.
5,735,731 A 4/1998 Lee
5,791,969 A 8/1998 Lund
5,944,588 A 8/1999 Marmillion et al.
5,958,794 A 9/1999 Bruxvoort et al.
5,967,881 A 10/1999 Tucker
6,220,936 B1 * 4/2001 Quek ..... 451/41
6,227,948 B1 5/2001 Khoury et al.
6,347,977 B1 * 2/2002 Frost ..... 451/6

* cited by examiner

*Primary Examiner*—George Nguyen
(74) *Attorney, Agent, or Firm*—James J. Cioffi; Cantor Colburn LLP

(57) ABSTRACT

An apparatus for performing semiconductor planarizing operations is disclosed. In an exemplary embodiment, the apparatus includes a carrier assembly for maintaining a workpiece therein in a face up orientation. A roller assembly includes a first cylindrical roller and a cylindrical second roller, the first and second rollers being linked to one another through a pair of arms. Each of the first and second rollers may be independently positioned with respect to a horizontal plane, the horizontal plane being substantially parallel to a top surface of the workpiece.

20 Claims, 2 Drawing Sheets

APPARATUS AND METHOD FOR FRONT SIDE CHEMICAL MECHANICAL PLANARIZATION (CMP) OF SEMICONDUCTOR WORKPIECES

BACKGROUND

The present invention relates generally to the manufacture of semiconductor integrated circuit devices and, more particularly, to an apparatus and method for front side chemical mechanical planarization of semiconductor workpieces.

Many electronic and computer-related products such as semiconductors, hard disks and CD-ROMS require highly polished or planarized surfaces in order to achieve optimum performance. In the semiconductor manufacturing industry, for example, silicon workpieces are used in the manufacture of integrated circuit components and the like. The workpieces are known in the industry as "wafers" and typically have a flat, circular disk-like shape. The wafers are initially sliced from a silicon ingot and, thereafter, undergo multiple masking, etching, and layer (e.g., dielectric and conductor) deposition processes to create microelectronic structures and circuitry on the wafers. The surface of a wafer undergoing these processes is typically polished or planarized between processing steps to ensure proper flatness, thereby permitting use of subsequent photolithographic processes for building additional dielectric and metallization layers on the wafer surface.

Accordingly, Chemical Mechanical Planarization or Polishing (CMP) machines have been developed to planarize or polish silicon wafer surfaces to a flat condition suitable for manufacture of integrated circuit components and the like. Existing CMP machines and processes typically utilize a wafer carrier or transport apparatus which is positioned above a polishing pad and configured to receive and hold one or more wafers therein. The carrier apparatus may include multiple heads for holding multiple wafers. In operation, the carrier apparatus is lowered such that the wafers held therein are pressed against the polishing pad while the polishing pad is rotated about its vertical axis. The wafers may also be rotated about their vertical axes and oscillated radically back and forth over the pad surface to improve polishing effectiveness.

Prior art CMP machines of this sort, while adequate in most respects, do have certain drawbacks. One such shortcoming of known CMP machines is a difficulty in achieving uniform pressure distribution across the surface of the wafer as it is pressed against the polishing pad. Attaining a uniform pressure distribution is important in that it fosters consistent and uniform polishing across the entire wafer surface. The difficulty in achieving uniform pressure distribution arises from the fact that the entire surface of the wafer is in contact with the polishing pad during polishing operations. Another drawback, arising from the conventional "face down" position that a wafer is held in during polishing, is the difficulty of visually or otherwise monitoring the polishing process for consistency and uniformity.

BRIEF SUMMARY

The above discussed and other drawbacks and deficiencies of the prior art are overcome or alleviated by an apparatus for performing semiconductor planarizing operations. In an exemplary embodiment, the apparatus includes a carrier assembly for maintaining a workpiece therein in a face up orientation. A roller assembly includes a first cylindrical roller and a cylindrical second roller, the first and second rollers being linked to one another through a pair of arms. Each of the first and second rollers may be independently positioned with respect to a horizontal plane, the horizontal plane being substantially parallel to a top surface of the workpiece.

Preferably, each of the pair of arms further includes an elbow, thereby providing a pivot point for each of the pair of arms. The apparatus further includes a first horizontally oriented spindle for mounting the first cylindrical roller thereon, and a second horizontally oriented spindle for mounting the second cylindrical roller thereon. The first and second rollers may each include a polish pad thereon, the polish pad being divided into a plurality of segments. In an alternative embodiment, one of the first and second rollers includes a polish pad mounted thereon and the other includes a brush mounted thereon. The carrier assembly preferably further includes a tray mounted upon a vertically oriented spindle, the tray maintaining the workpiece therein in the face up orientation. An endpoint measuring device is used for measuring a thickness of the workpiece.

BRIEF DESCRIPTION OF THE DRAWINGS

Referring to the exemplary drawings wherein like elements are numbered alike in the several Figures.

DETAILED DESCRIPTION

Figure 1:
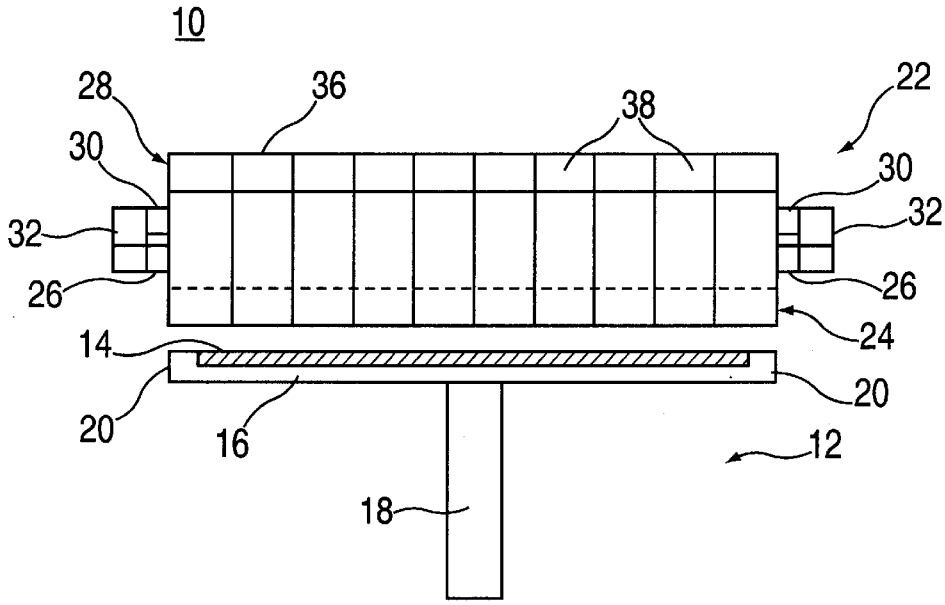
FIG. 1 is a side view of a planarization apparatus, including a carrier assembly and a roller assembly, in accordance with an embodiment of the invention.
Figure 2:
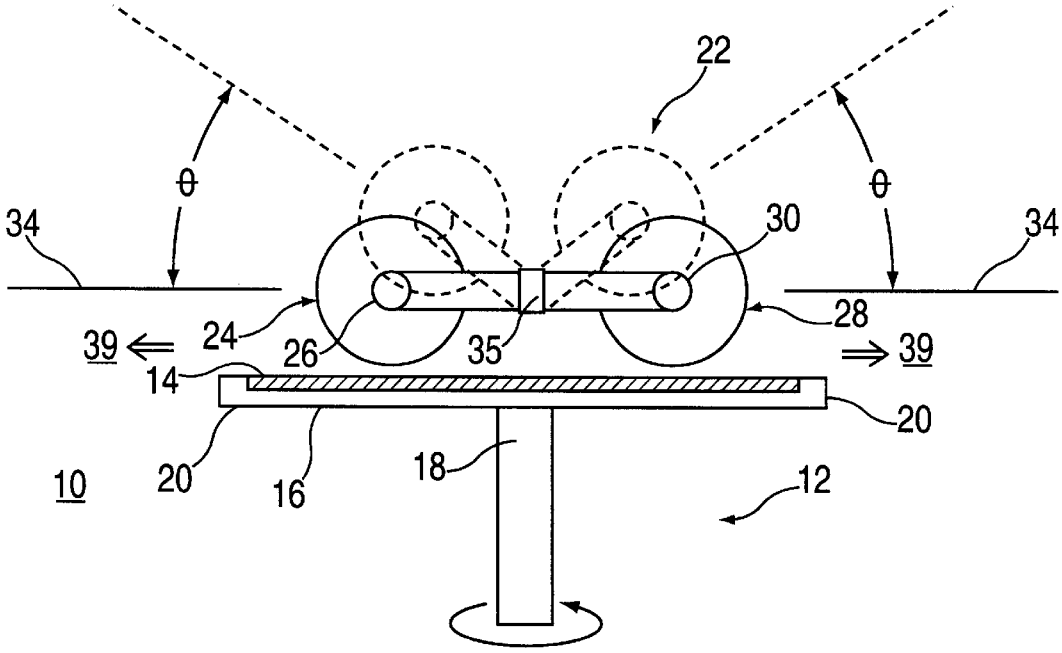
FIG. 2 is end view of the apparatus shown in FIG. 1.
Figure 3:
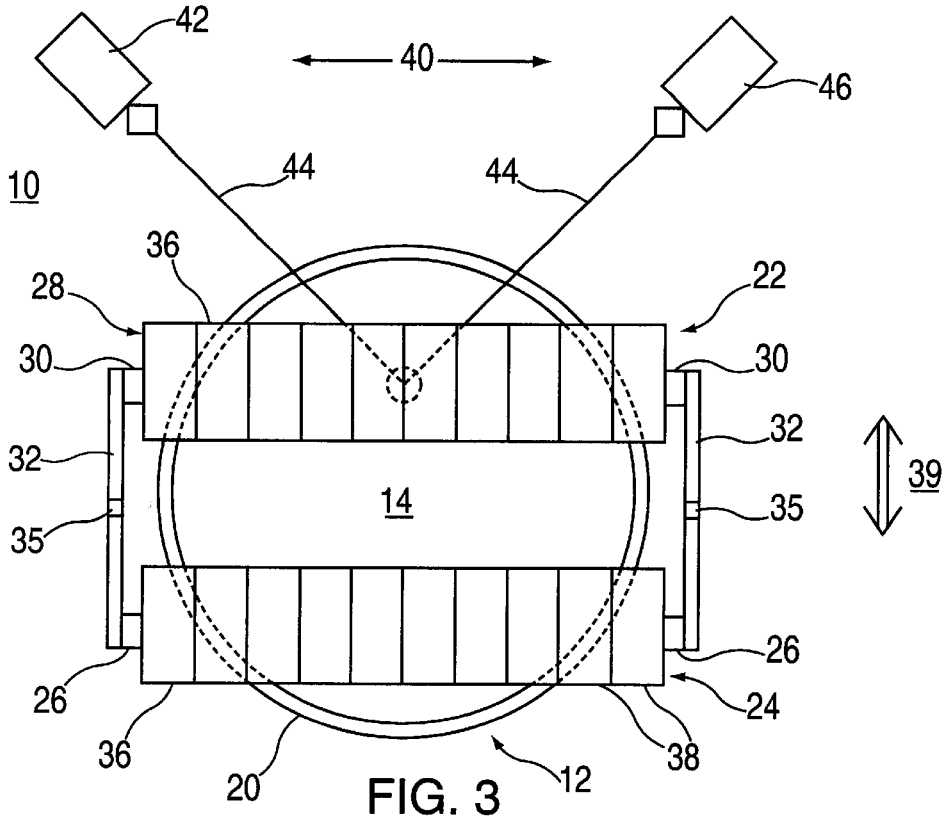
FIG. 3 is a top view of the apparatus shown in FIGS. 1 and 2, further illustrating a process endpoint detection and measurement means.

Referring generally to FIGS. 1 through 3, there is shown a planarization apparatus 10 for chemical mechanical polishing (CMP) and/or brushing of a workpiece, in accordance with an embodiment of the invention. A carrier assembly 12 for holding a workpiece, such as semiconductor wafer 14, includes a tray 16 mounted atop a vertically oriented spindle 18. A sidewall 20 on tray 16 maintains the wafer 14 therein in a "face up" orientation for a planarization operation, polishing operation, brush cleaning or other related operation applied to the wafer 14. Other retaining mechanisms, such as a vacuum chuck or a retaining ring may also be used. The carrier assembly 12 is designed to be rotated about a vertical axis through the spindle 18. For purposes of illustration, the tray 16 and wafer 14 are illustrated in cross section in the Figures so as to show the arrangement therebetween.

A roller assembly 22 includes a first cylindrical roller 24 mounted upon a first horizontally oriented spindle 26. A second cylindrical roller 28 is correspondingly mounted upon a second horizontally oriented spindle 30. The first cylindrical roller 24 is affixed with respect to horizontally oriented spindle 26 such that rotation of the spindle 26 effects simultaneous rotation of roller 24. Similarly, the second cylindrical roller 28 is affixed with respect to horizontally oriented spindle 30 such that rotation of spindle 30 effects simultaneous rotation of roller 28. As will be described in further detail, one possible use for apparatus 10 is to implement one of the first or second cylindrical rollers in a polishing/planarizing capacity, while the other roller may be implemented in a brushing or cleaning capacity with respect to the wafer 14.

Both the first cylindrical roller 24 and the second cylindrical roller 28 are linked to one another at each end thereof (through horizontally oriented spindles 26 and 30, respectively) by arms 32. The arms 32, in conjunction with one another, provide for relative movement between the first and second rollers 24, 28 with respect to a horizontal plane 34 that is substantially parallel to the tray 16 of carrier assembly 12. This is shown most particularly in FIG. 2. In other words, one of the rollers may be placed in a relatively vertical or upright position (i.e., away from the wafer 14 surface) with respect to the other roller.

An elbow 35, disposed roughly midway along the length of each arm 32, provides a pivot point for each arm 32 to facilitate the relative movement between the rollers. As can be seen in FIG. 2, both rollers may be extended upward, through an angle θ, with respect to horizontal plane 34. Preferably, θ is about 45 degrees, but could be smaller or larger depending upon system requirements and/or the selected size of the rollers and the distance therebetween when the arms are in a fully extended position. In FIG. 1, it will be noted that the second roller 28 is disposed at an acute angle with respect to the horizontal plane and this second roller 28 is shown partially in phantom behind the first roller 24. Alternatively, in addition to (or in lieu of) elbows 35, the arms 32 could also be designed to pivot at each roller spindle 26, 30, so as to allow one roller to be positioned directly over the other roller.

Referring once again to FIGS. 1 and 3, each roller is furnished with a polish pad 36 (or brush), depending upon the desired wafer operation. In the embodiment depicted, the polish pad 36 (or brush) is preferably divided into a plurality of segments 38 for contour control. Each segment 38 further preferably contains a bladder mechanism (not shown) therein for selective inflation or deflation thereof, as the case may be, so as to provide a desired pad/brush contour for the contact surface applied to wafer 14. Additional details regarding the contouring of a polish pad or brush may be found in U.S. patent application Ser. No. 09/391,439, filed on Sep. 8, 1999, the contents of which are incorporated herein by reference.

In the operation of apparatus 10, an upward force may be applied to the carrier assembly 12 while a downward force is applied to the roller assembly 22 so as to provide a downward force on the wafer 14. A polishing or brushing operation is further executed with the rotation of the carrier assembly 12 about the vertical axis of spindle 18, as well as the rotation of either the first roller 24, the second roller 28 or both. In a CMP operation, a slurry solution (not shown) is preferably applied between the wafer 14 surface and the rollers (e.g., such as by a slurry tube or other mechanism) to aid in the polishing process.

In addition to the upward and downward movement of rollers 24, 28 with respect to horizontal plane 34, the apparatus 10 also provides for horizontal translation of the rollers across the surface of the wafer 14 as indicated by arrows 39 in FIGS. 2 and 3. Furthermore, the carrier assembly 12 could also be configured upon a track (not shown) so as to provide independent lateral movement of the carrier assembly 12 with respect to the roller assembly 22. The relative movement between the carrier assembly 12 and the roller assembly 22 can result in an oscillating, circular or other desired polishing/cleaning pattern.

FIG. 3 particularly illustrates a further advantage of apparatus 10. By configuring the carrier assembly 12 so as to secure wafer 14 in a face up orientation, as well as configuring the roller assembly 22 as described above, direct visual inspection and endpoint detection of the polishing/cleaning process is facilitated. For example, an endpoint measurement device such as an ellipsometer may be used to accurately measure the thickness of the semiconductor wafer 14. Such devices can provide accuracies in the angstrom range. Thus, in FIG. 3, apparatus 10 may further include an endpoint measurement device 40 featuring a laser emitting device 42 that emits a beam 44 of polarized light which, in turn, is reflected off the surface of the wafer 14 and is detected by detecting device 46. Rather than relying on an estimate of the polishing time needed to produce a desired layer thickness, as is the case for existing "face down" polishing techniques, the endpoint measurement feature provides real time process monitoring and, thus, more accurate CMP operations. In addition to an ellipsometer, other endpoint measurement devices which may be implemented include, but are not limited to interferometers and laser diode measurement devices.

Still a further benefit of the above described apparatus 10 may be a reduced amount of time taken in between different polishing operations, thereby increasing throughput. For example, the first roller 24 could be provided with a polishing pad while the second roller 28 could be provided with a touch-up polishing pad or brush. Ordinarily, a final polished product is realized after processing at numerous stations, each configured to suit an individual processing step performed. The multiple-function roller apparatus 10, implemented at several stations, can be used to combine steps and save time in transporting a wafer from station to station. Pad changes can also be accomplished in a more cost effective manner.

Figure 4:
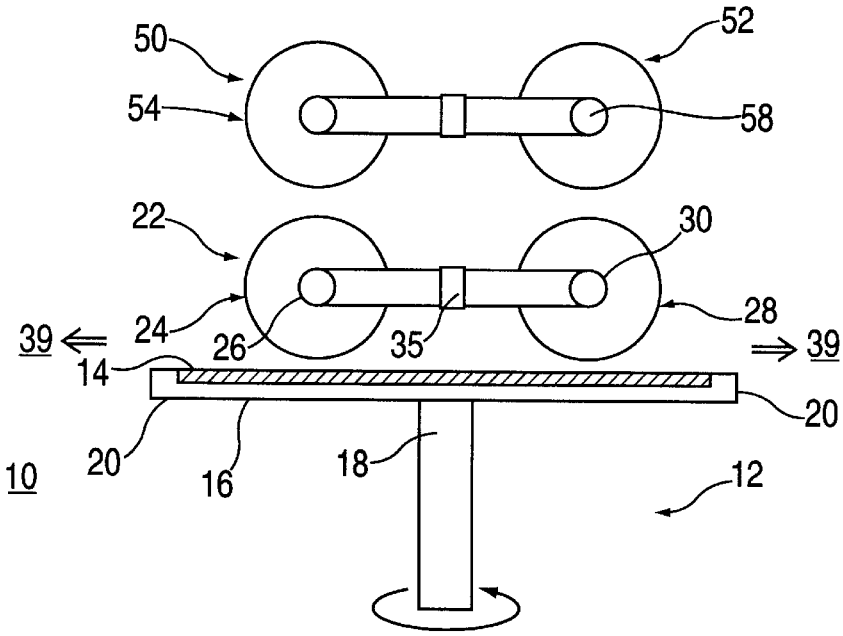
FIG. 4 is an end view of an alternative embodiment of the apparatus shown in FIG. 2, further including a conditioning assembly for conditioning pads and/or brushes included on the roller assembly.

Finally, FIG. 4 illustrates a conditioning assembly 50 which may be optionally included within apparatus 10. During CMP processing operations, it is generally desirable from time to time to condition the pads or brushes used on the roller assembly 22 so as to restore a uniform surface thereto. Disposed generally above the roller assembly 22, the conditioning assembly 50 includes a pair of rollers 52, 54 mounted on spindles 56 and 58, respectively. The rollers 52, 54 are designed to be rotated and brought down into removable engagement with rollers 24 and 28, respectively, (and thus the pad or brush material thereon) in between wafer polishing operations. Further, rollers 52 and 54 are outfitted with coarse material (e.g., a diamond embedded material) to provide the abrasive action for producing a uniform pad or brush surface on rollers 24 and 28. The conditioning assembly 50 may have a configuration similar to that of the roller assembly 24 (as shown in FIG. 4); however, this need not be the case.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for performing semiconductor planarizing operations, comprising:

a carrier assembly for maintaining a workpiece therein in a face up orientation;

a roller assembly including a first cylindrical roller and a cylindrical second roller; and said first and second rollers being linked to one another through a pair of arms;

wherein each of said first and second rollers may be independently positioned with respect to a horizontal plane, said horizontal plane being substantially parallel to a top surface of said workpiece.

2. The apparatus of claim 1, wherein each of said pair of arms further includes an elbow, said elbow thereby providing a pivot point for each of said pair of arms.

3. The apparatus of claim 2, further comprising:

a first horizontally oriented spindle for mounting said first cylindrical roller thereon; and a second horizontally oriented spindle for mounting said second cylindrical roller thereon.

4. The apparatus of claim 1, wherein said first and second rollers each include a polish pad thereon, said polish pad being divided into a plurality of segments.

5. The apparatus of claim 1, wherein one of said first and second rollers includes a polish pad mounted thereon and the other of said first and second rollers includes a brush mounted thereon.

6. The apparatus of claim 1, wherein said carrier assembly further comprises a tray mounted upon a vertically oriented spindle, said tray maintaining said workpiece therein in said face up orientation.

7. The apparatus of claim 1, further comprising an endpoint measuring device for measuring a thickness of said workpiece.

8. The apparatus of claim 7, wherein said endpoint measuring device further comprises:

a laser emitting device, configured to generate a reflecting beam of polarized light off of said workpiece; and a detecting device configured to detect said reflected beam of polarized light.

9. An apparatus for performing semiconductor planarizing operations, comprising:

a carrier assembly for maintaining a workpiece therein in a face up orientation;

a roller assembly including a first cylindrical roller and a cylindrical second roller, said first and second rollers being linked to one another through a pair of arms, and each of said pair of arms further including an elbow, said elbow providing a pivot point for each of said pair of arms;

a first horizontally oriented spindle for mounting said first cylindrical roller thereon;

a second horizontally oriented spindle for mounting said second cylindrical roller thereon;

a polish pad mounted on one of said first and second rollers; and a brush mounted on the other of said first and second rollers;

wherein each of said first and second rollers may be independently positioned with respect to a horizontal plane, said horizontal plane being substantially parallel to a top surface of said workpiece.

10. The apparatus of claim 9, further comprising an endpoint measuring device for measuring a thickness of said workpiece, said endpoint measuring device further comprising:

a laser emitting device, configured to generate a reflecting beam of polarized light off of said workpiece; and a detecting device configured to detect said reflected beam of polarized light.

11. The apparatus of claim 10, further comprising:

a conditioning assembly, disposed above said roller assembly, said conditioning assembly including a pair of rollers thereon for removable engagement with said roller assembly.

12. The apparatus of claim 10, wherein said pair of rollers in said conditioning assembly further include a coarse material thereon.

13. A method for planarizing a semiconductor workpiece, the method comprising:

configuring a carrier assembly for maintaining a workpiece therein in a face up orientation;

configuring a roller assembly including a first cylindrical roller and a cylindrical second roller, said first and second rollers being linked to one another through a pair of arms;

independently positioning said first and second cylindrical rollers with respect to a horizontal plane, said horizontal plane being substantially parallel to a top surface of said workpiece; and applying at least one of said first and second cylindrical rollers to said top surface of said workpiece.

14. The method of claim 13, wherein each of said pair of arms further includes an elbow, said elbow thereby providing a pivot point for each of said pair of arms.

15. The method of claim 13, wherein one of said first and second rollers includes a polish pad mounted thereon and the other of said first and second rollers includes a brush mounted thereon.

16. The method of claim 13, wherein said carrier assembly further comprises a tray mounted upon a vertically oriented spindle, said tray maintaining said workpiece therein in said face up orientation.

17. The method of claim 13, further comprising configuring an endpoint measuring device for measuring a thickness of said workpiece.

18. The method of claim 17, wherein said endpoint measuring device further comprises:

a laser emitting device, configured to generate a reflecting beam of polarized light off of said workpiece; and a detecting device configured to detect said reflected beam of polarized light.

19. The method of claim 15, further comprising:

performing a polishing operation with said one of said first and second rollers; and performing a brushing operation with said other of said first and second rollers.

20. The method of claim 19, wherein:

when a polishing operation is performed with said one of said first and second rollers, said other of said first and second rollers is maintained at an acute angle with respect to said horizontal plane; and when a brushing operation is performed with said other of said first and second rollers, said one of said first and second rollers is maintained at an acute angle with respect to said horizontal plane.

* * * * *